United States Patent [19]

Kime

[11] 4,271,791

[45] Jun. 9, 1981

[54] RAPID RESPONSE STEAM GENERATOR II

[76] Inventor: Wellesley R. Kime, 8745 Appian Way, Los Angeles, Calif. 90046

[21] Appl. No.: 50,820

[22] Filed: Jun. 21, 1979

[51] Int. Cl.[3] ..... F22B 27/00

[52] U.S. Cl. ..... 122/39; 122/40; 122/487; 122/166 R

[58] Field of Search ..... 122/39, 40, 460, 476, 122/467, 468, 459, 479 R, 482, 487, 131, 134, 48, 158 A, 166 R, 183, 348

[56] References Cited

U.S. PATENT DOCUMENTS

| | | | |
|---|---|---|---|
| 1,090,779 | 3/1914 | Dailey | 122/158 |
| 1,527,740 | 2/1925 | Lipshitz | 122/39 |
| 1,706,360 | 3/1929 | Newhouse | 122/479 A |
| 1,802,578 | 4/1931 | Schnepp | 122/183 |
| 1,806,216 | 5/1931 | Plummer | 122/39 |
| 1,980,425 | 11/1934 | Morgan | 122/183 |
| 2,033,185 | 3/1936 | Dodd | 122/459 |
| 2,790,428 | 4/1957 | Buttler | 122/134 |
| 3,734,066 | 5/1973 | Scheyen | 122/367 R |

*Primary Examiner*—Henry C. Yuen

[57] ABSTRACT

A rapid response steam generator wherein steam pressure is generated by moving fluid in contact with preheated metal in a heat exchanger having vertical grooves surrounding a downwardly expanding central passage, the passage having an obturator urged upwardly for directing the fluid being heated into the vertical grooves. The obturator is movable downwardly for releasing excess pressure into the central passage. Liquid is stored in a cylindrical housing below said heat exchanger. Steam is discharged through upwardly directed discharge means in the cylindrical housing positioned below said heat exchanger. Liquid is stored in said cylindrical housing and is pumped to the said heat exchanger for steam generation. Superheated steam, if formed in said heat exchanger, passes through fiberous or particulate matter saturated with liquid in the cylindrical housing for generating additional steam.

18 Claims, 6 Drawing Figures

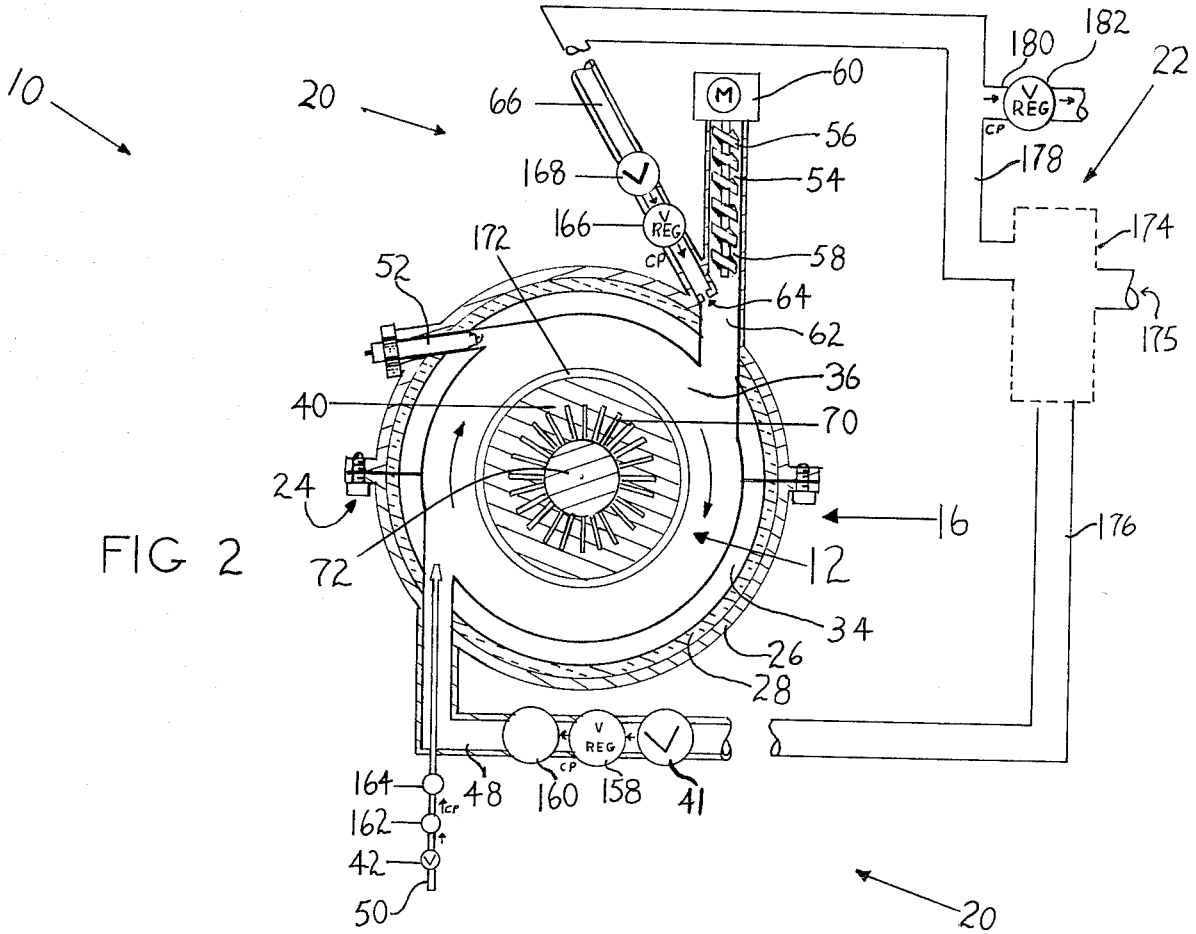
FIG 2
FIG 3
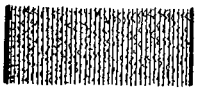
FIG 4
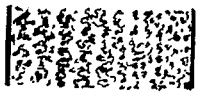
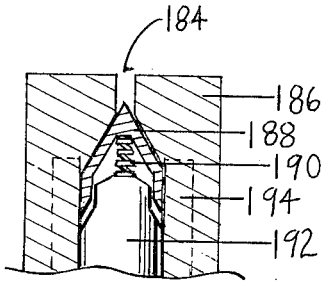
FIG 5

RAPID RESPONSE STEAM GENERATOR II

CROSS-REFERENCE TO RELATED PATENT APPLICATIONS

The invention is utilized in combination with Floating Piston and Centrifugal Molecular Air Separator disclosed in co-pending U.S. Patent Applications of same inventor. (Also with Laser Powered Solid Fuel Disintegrator)

BACKGROUND OF INVENTION

On Apr. 25, 1979, the inventor filed patent application Ser. No. 023,935, group 344, which disclosed a rapid response steam generator utilizing the principal of superheating steam by moving steam in contact with a pre-heated surface then utilizing superheated steam as the heat source for vaporizing liquid to steam. The device disclosed in said patent application also generated steam by moving a liquid into contact with a pre-heated metal surface.

Although the apparatus disclosed in the present patent application differs substantially from the apparatus disclosed in the aforesaid application, the present application is a continuation of the aforesaid application in that steam is generated by contact of liquid with a pre-heated surface and superheated steam, if generated, is utilized as a heat source for generating additional steam.

DEFINITION OF TERMS

As used in this application and in the appended claims, the word "oxygen" means a gaseous substance containing oxygen used for the combustion of fuel.

As used in this application and in the appended claims, the term "molecular oxygen" refers to a gaseous substance containing oxygen in a higher concentration than that of atmospheric air.

As used in this application and in the appended claims, the term "molecular nitrogen" refers to a gaseous substance containing nitrogen in a higher concentration than that of atmospheric air.

As used in this application and in the appended claims, the term "super-heated steam" refers to steam at a temperature above the boiling point of liquid at the target pressure.

As used in this application and in the appended claims, the term "steam" refers to vapor obtained from heating a liquid chosen for use in the apparatus, above the boiling point.

SUMMARY OF THE INVENTION

Accordingly, object of the invention is to provide a novel apparatus for rapid commencement and termination of steam generation. An object is to generate steam without waiting for metal to be heated to transfer heat to a liquid. To accomplish this goal, liquid is moved into contact with pre-heated metal.

An object of the invention is to provide a large surface area of heated metal for contact with liquid, and to provide this within a small apparatus. This is accomplished by typically providing grooves in the heated metal through which the liquid passes. The grooves are typically aligned with the radius of the heat transfer cylinder, the width of the grooves being relatively large (to provide increased area for the flow of liquid and steam) whereas the height of the grooves being relatively small to break up drops of liquid which may form and to provide close contact of heated surfaces with liquid.

Another object of the invention is to provide a means for essentially evenly distributing the liquid in the grooves.

Yet another object of the invention is to provide a means for releasing excessive pressure build-up within the confined area where fluid is distributed to the grooves and within the grooves.

Another object of the invention is to provide a means for utilizing alternate fuels. Means are provided for the control of volume flow of any liquid or gaseous fuel into the combustion chamber and flow of oxygen into the combustion chamber. Means is also provided for control of the flow of pulverized solid fuel into the combustion chamber.

Another object of the invention is to provide for increased fuel efficiency by providing means for burning the fuel with molecular oxygen. The combustion chamber is lined with refractory material to enable a more intense heat to be maintained within the combustion chamber.

Yet another object of the invention is to provide a means for automatically controlling the commencement and termination of fuel and oxygen to the combustion chamber. This is accomplished by using one or more thermostats at various locations within the apparatus to control the "on-off" valves for the flow of fluid fuel and oxygen and to control the motor which activates the powdered fuel feed assembly.

Another object of the invention is to automatically control the pressure within the apparatus at a predetermined target pressure. This is accomplished by using pressure responsive means to control the flow of liquid which is moved to the surface of the heated metal. As pressure within the apparatus decreases, the flow of liquid to the heated metal surface increases and vice versa.

An additional object of the invention is to retain liquid within the apparatus which is not vaporized by contact with the hot metal (but has passed through the longitudinal grooves). This is accomplished by providing a "liquid trap" wherein liquid is maintained while steam is allowed to be discharged from the apparatus.

Another object of the invention is to utilize heat for energy in steam which is superheated by contact with the pre-heated metal. This is accomplished by passing the super-heated steam through fiberous or particulate matter which is saturated with liquid. The super-heated steam vaporizes liquid and generates additional steam while lowering in temperature to (or near) the boiling point of the liquid at the target pressure.

The apparatus is typically used in conjunction with a molecular air separator (any suitable type as for example a centrifugal type or type using molecular sieve) for separating air into its constituent parts, molecular oxygen (for providing a hotter combustion) and molecular nitrogen (optionally for blowing pulverized solid or laser disintegrated fuel etc. into the combustion chamber).

The combustion chamber is annular in peripheral geometry and tends to retain unburned fuel and incompletely burned products of combustion by centrifugal force whereas the lighter completely burned products of combustion more easily pass over an inwardly directed annular ring. The annular combustion chamber additionally provides continuous intense heat for promoting complete combustion of fuels by reason of the circular path of burning fuel.

Also an object of the invention is to provide a rapid response steam generator of the character described which is easy to operate, economical to manufacture, and simple as regards its construction.

Further objects, features and advantages will become apparent to those skilled in the art from the following description when taken into connection with the attached drawings, in which:

BRIEF DESCRIPTION OF DRAWINGS

FIG. 2 is a cross-sectional view of the steam generator taken on the line 2—2 of FIG. 1.

FIG. 3 is a cartridge containing fiberous material which may be inserted in the base assembly of the steam generator, and FIG. 4 is a cartridge containing particulate matter which may be inserted in the base assembly of the steam generator.

FIG. 5 is a plan view in cross section of the top end of the heat transfer assembly showing an alternate means of directing liquid in equal amounts to the longitudinal grooves in the heat transfer assembly.

DESCRIPTION OF THE PREFERRED EMBODIMENT

Figure 1:
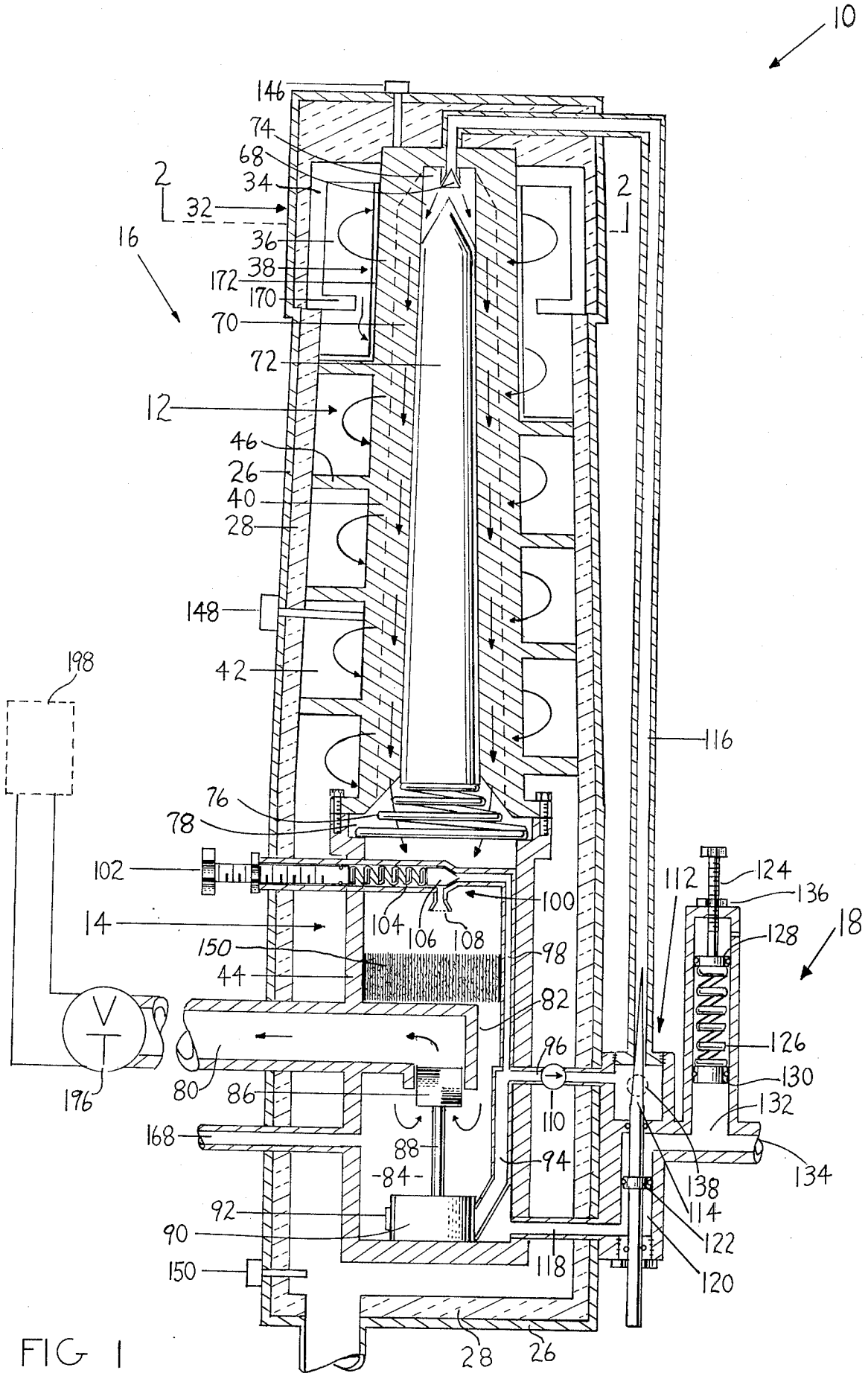
FIG. 1 is a plan view in cross-section of the Rapid Response Steam Generator II embodying the present invention.

Referring now to the drawings in which like reference numerals index like parts and with attention initially directed to FIG. 1, there is shown a Rapid Response Steam Generator II, referenced generally by the numeral 10, and constructed in accordance with the invention.

Device 10, in the arrangement according to the invention, comprises heat transfer assembly 12 and a base assembly 14, surrounded by a heating assembly 16. The device also comprises pressure control assembly 18, and as shown in FIG. 1, it additionally comprises combustion control assemblies 20, FIG. 2.

The invention typically is used with and may incorporate a molecular air separator 22, which separates air into its constituent parts, molecular oxygen (used in the heating assembly for obtaining a hotter combustion) and molecular nitrogen (optionally used to blow pulverized powdered fuel into the heating assembly).

Heating assembly 16 is formed in two halves which are bolted together by bolts 24 as shown in FIG. 2. Heating assembly 16 comprises an outer metal sheath 26 with an inner layer of heat and cold insulating material 28, which in firebox 32 also comprises a heat refractory material (and oxidation resistant material) 34 such as for example ceramic composition material.

Heating assembly 16 when mounted in position and bolted together forms combustion chamber 36 between heat refractory material 34 and top section 38 of heat transfer cylinder 40, the latter being part of heat transfer assembly 12. The mounted heating assembly 16 also forms heat conserving chamber 42 between the inner surface of the heat and cold insulating material 28 and peripheral portion of the heat transfer cylinder 40 which is not surrounded by the combustion chamber, and cylindrical housing 44 of base assembly 14. The heat transfer cylinder 40 additionally comprises lateral projections 46 which retain the heating assembly 16 at a predetermined distance from the heat transfer cylinder 40 and the cylindrical housing 44. Lateral projections 46 are formed so as to cause the heat conserving chamber to have a spiral pathway around the heat transfer cylinder 40. Oxygen is injected into the combustion chamber 36 via oxygen intake passage 48, FIG. 2. Gaseous fuel or liquid fuel is injected through fluid fuel intake tube 50. (A separate fuel injection tube may be used for liquid and gaseous fuels, however this was not shown in the drawing for the sake of simplicity). The liquid or gaseous fuel and oxygen are injected with such force as to cause the said substances to have a circular path around heat transfer cylinder 40 as shown by the arrows in combustion chamber 36 of FIG. 2. The oxygen fuel mixture is ignited by ignition device 52 which in this instance is shown in the form of a spark plug but may be in the form of a fuel ignitor or any other suitable device. Pulverized solid fuel is advanced through feed tube 54 by worm screw 56 which is attached to shaft 58, rotated by motor 60. The pulverized solid fuel is dropped into feed tube 54 via a supply tube not shown. Pulverized solid fuel is blown through common passage 62 via a gaseous substance, typically molecular nitrogen, injected through restrictive opening 64 of gaseous intake tube 66.

Liquid to be vaporized is injected through spray head 68 into longitudinal grooves 70 of heat transfer cylinder 40. The liquid is retained in longitudinal grooves 70 by obturator 72 which is tapered slightly to conform with the slight taper of the inner circumferential groove 74 extending downward from the top area of the heat transfer cylinder 40. Obturator 72 is urged in an upward position by resilient means which in this instance is spring 76, which rests below on a circumferential groove 78 located at the top open end of cylindrical housing 44. Should pressure of vaporizing gasses in the upper portion of circumferential groove 74 in heat transfer cylinder 40 exceed the resilient force of spring 76 (less the weight of obturator 72), obturator 72 will be forced downwardly thereby allowing vapor and liquid to escape between the outer surface of the obturator and the inner surface of the circumferential groove 74. Excessive pressure within longitudinal grooves 70 will cause a back-up of pressure within circumferential groove 74 with the same result.

Liquid is vaporized in longitudinal grooves 70 and the steam passes into the cylindrical housing 44 of base assembly 14 and is discharged through outlet tube 80. Outlet 80 is turned downward at 82 to provide a liquid trap. Liquid which may not have been vaporized in the heat transfer cylinder 40 falls past discharge tube 80 and is retained in the lower interior section 84 of cylindrical housing 44. Vapor entering the opening of discharge tube 80 rotates rotatable blade 86, which turns shaft 88, which activates rotary pump 90 (the latter being of any suitable type as for example a gear pump or sliding vane pump). Activation of rotary pump 90 causes liquid to be forced into tube 94 which divides into tubes 96 and 98. Liquid in tube 98 passes into pressure release valve 100.

Adjustable turning bolt 102 applies force against spring 104 which urges valve pin 106 in the closed position. When the pressure in tube 98 exceeds the tension exerted on valve pin 106 by spring 104, valve pin 106 is forced backward and fluid passes through valve 100 and is discharged through spray head 108. Fluid in tube 96 passes through one-way valve 110 and into needle valve 112. The flow of liquid through the needle valve 112 is controlled by pin 114 which moves up or down and regulates the discharge of liquid into tube 116. Pressure of liquid in the lower portion 84 of the interior of cylindrical housing 44 causes fluid to flow in tube 118, to cylinder 120, which forces piston 122 and attached pin 114 in the upward position. Turning bolt 124 applies pressure on spring 126 via end plate 128. Spring 126 urges piston 130 in a downward position exerting pressure on liquid 132 (typically hydraulic fluid) which forces piston 122 and pin 114 in a downward position thereby opening valve 112 and allowing the flow of liquid into tube 116 then through spray head 68 of heat transfer assembly 12. Tube 134 is connected with a gauge (not shown) for determining the pressure of hydraulic fluid in pressure control valve 18. Tube 134 is also connected to means (not shown) for adding or removing hydraulic fluid. Thus, the flow of liquid into heat transfer assembly 12 is controlled by pressure control assembly 18 which is responsive to pressure within the cylindrical housing 44 of base assembly 14. The target pressure within cylindrical housing 44 is predetermined and adjustable by controlling the tension on resilient means 126 which in this instance is a spring. Turning bolt 124 when in position is held in place by lock nut 136. For priming purposes, liquid is passed through opening 138 into needle valve 112. Also, shaft 88 may be extended downwardly through the bottom end of cylindrical housing 44 and the layer of insulating material 28 and metal sheath 26 (with use of pressure sealing means and bearing means) to an auxiliary means of activating rotary pump 90, as for example an electric motor or steam operated pressure motor.

Oxygen flowing through tube 48 and fluid fuel flowing through tube 50 are turned on and off via valves 41 and 42 respectively. Said valves and motor 60 controlling worm screw 54 are activated or deactivated by adjustable thermostats (temperature controlled switches). Thermostat 146 senses the temperature at the top end of the heat transfer cylinder, thermostat 148 typically senses the temperature in the middle or lower part of heat transfer cylinder 40, and thermostat 150 senses the temperature of exhaust gasses typically in the lower part of the heat conservation chamber. For maximum steam generation thermostat 146 only is used. Thermostats 148 and/or 150 are added (in series with thermostat 146) for increased fuel efficiency. Thermostats 148 and/or 150 may be optionally placed at other locations for specific operating conditions. If thermostat 148, located in its present position as shown in FIG. 1, is set at a sufficiently low maximum cut-off temperature, superheated steam will not be discharged from heat transfer assembly 12 into base assembly 14. If thermostat 148 is adjusted to a sufficiently high maximum cut-off temperature so that superheated steam is discharged into base assembly 14, cartridge 150 containing fiberous material, FIG. 3, as for example fiberglas, or particulate matter, FIG. 4, as for example ceramic pieces, is placed below spray head 108 so that the material is saturated with liquid. The liquid has a large surface area exposed to the superheated steam passing through the cartridge, and the liquid absorbs the excess heat in the superheated steam. Additional steam is thus generated utilizing the excess heat in the superheated steam and the superheated steam is lowered to (or near) the temperature of the boiling point of the liquid at the target operating pressure of the apparatus. Any suitable material may be used to absorb or adsorb liquid discharged from spray head 108.

Motor 60 is of the adjustable speed variety and is typically run at constant speed for a given pulverized solid fuel and the amount of oxygen required for the maximum fuel effeciency for the speed of motor 60 is regulated by adjusting the pressure of constant pressure outlet valve 158 and the size of restrictive orifice 160 of oxygen intake tube 48. Likewise, the setting of constant pressure outlet valve 162 and the size of restrictive orifice 164 of fluid fuel intake tube 50 is adjusted to match the oxygen requirements of the fluid fuel with the volume flow of oxygen through intake tube 48 as controlled by adjusting constant pressure outlet valve 158 and restrictive orifice 160.

When pulverized solid fuel is used, the minimum amount of nitrogen necessary for blowing the solid fuel through common passage 62 into the combustion chamber is obtained by adjusting constant pressure outlet valve 166 and the size of restrictive orifice 64. Nitrogen is turned on and off by valve 168 which is electrically connected with at least one of the aforesaid thermostats, as is motor 60 and "on-off" valves 40 for oxygen and 42 for fluid fuel.

Pulverized solid fuel may be difficult to ignite particularly if particles are not reduced to an extremely small size. Ignition of pulverized solid fuels may be enhanced by the addition of a highly flammable fluid fuel. An annular combustion chamber of the type described is particularly suitable for utilizing fuels which are difficult to completely burn by reason of the fact unburned particles tend to be held in the combustion chamber 36 by centrifugal force until completely consumed and the lighter products of combustion more easily flow around the inwardly projecting annular ring 170. The burning fuel in combustion chamber 36 becomes intensely hot, promoting complete combustion of fuel. The metal surface of the heat exchange cylinder at 38 is protected from the intense heat of circling flames by a coating of heat and oxidation resistant material 172, as for example Teflon.

A pressure release valve, not shown, is used to allow the release of excessive pressure as a safety precaution. Tube 168 is used to supply additional liquid as needed to the interior of cylindrical housing 44 as well as to permit the discharge of excess liquid from said interior. A float valve assembly or other suitable means may be used to control the level of liquid in lower portion 84 of the cylindrical housing 44. Heat transfer fins may be used to increase the heat transfer from the heat conserving chamber 42 to heat transfer cylinder 40. The heat conserving chamber 42 may be in the form of a straight passage by omitting the lateral projections 46 which convert the heat conserving chamber into a spiral pathway. A pressure gauge may additionally be provided to show the pressure within the cylindrical housing at all times.

Typically, molecular air separator indexed by dashed lines 174 is used in conjunction with the apparatus and may comprise part of the apparatus. Air enters the molecular air separator through intake tube 175 and is separated into its constituent parts, molecular oxygen which is discharged through tube 176, which joins oxygen intake tube 48 of the heating assembly; and molecular nitrogen which is discharged through discharge outlet 178, which joins nitrogen intake tube 66 of the heating assembly. The molecular air separator provides more nitrogen than oxygen although apparatus 10 typically utilizes more oxygen than nitrogen. Excess nitrogen is expelled through tube 180 after passing through constant pressure inlet valve 182 which is adjusted to maintain the desired nitrogen pressure within tube 178.

FIG. 5 shows an alternate means (in place of spray head 68, FIG. 6) of dispersing liquid to be vaporized in essentially equal amounts to the longitudinal grooves in the heat transfer cylinder. Liquid enters the intake passage 184 at the top end of the heat transfer cylinder 186 and flows around cone shaped liquid dispersing plate 188 which conforms in geometry to the top end of the inner circumferential groove of the heat transfer assembly. Dispersing plate 188 is urged upward by resilient means which in this instance is spring 190 which presses against obturator 192. The resiliency of spring 190 is not sufficient to significantly retard the flow of liquid but is sufficient to fan the liquid into a thin layer which flows equally into longitudinal grooves 194.

Associated with outlet tube 80 is a throttle valve 196, FIG. 1, which, when opened, allows steam to escape from cylindrical housing 44, to activate a steam-utilizing mechanism as, for instance, the pistons of a steam engine indexed generally by dashed lines 198.

Upon release of steam from outlet 80, the pressure within cylindrical housing 44 drops, permitting liquid to flow through pressure control assembly 18 as aforesaid, thereby to reestablish vaporization by means described above.

Figure 6:
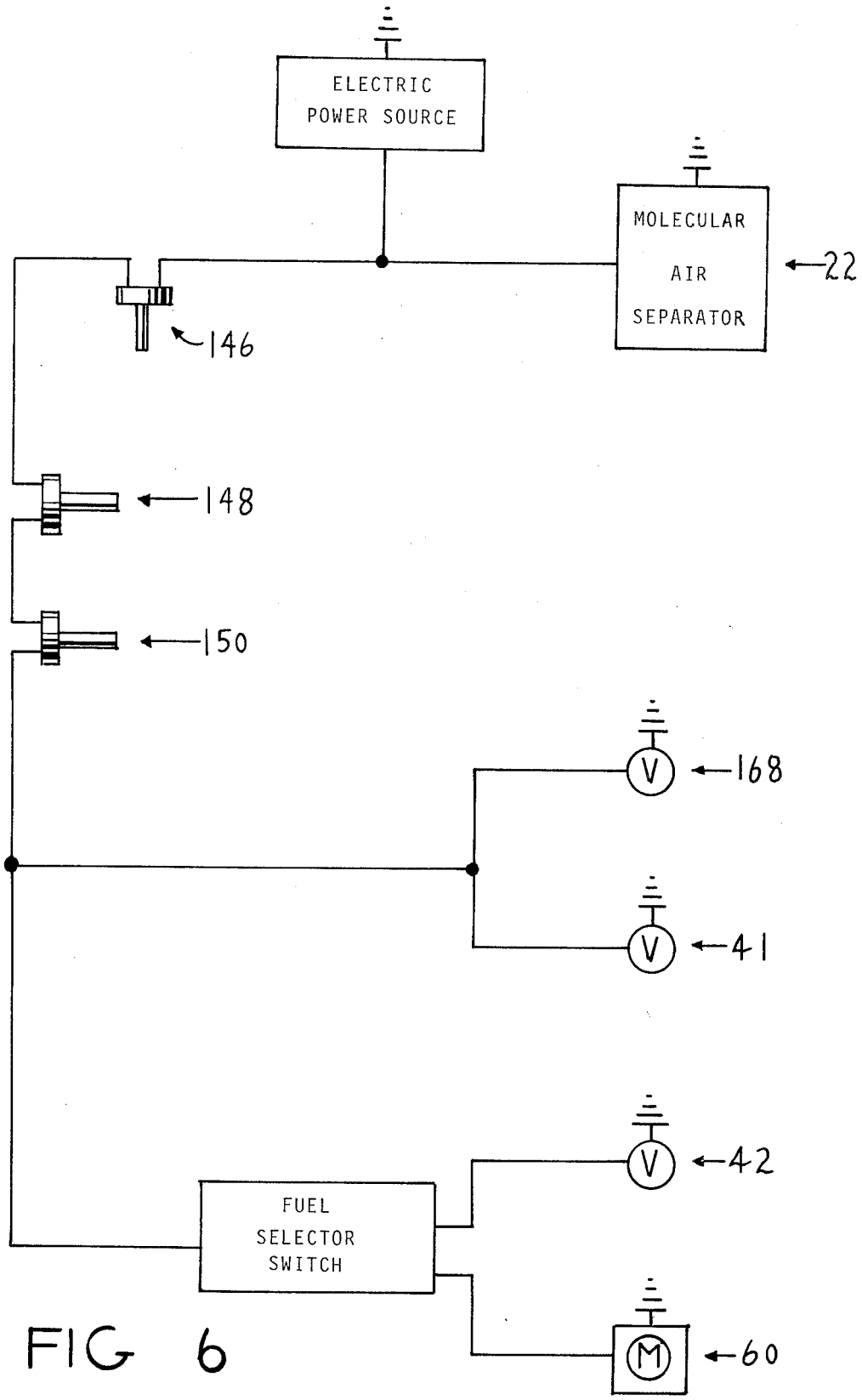
FIG. 6 is a schematic representation of a control circuit.

In FIG. 6, "hot" lead 200 from a suitable power source, as for example a battery and main power switch, not shown, is coupled with the molecular air separator 22 and with thermostats 146, 148, and 150 (in series). From the thermostats, the "hot" lead is coupled with nitrogen valve 168, oxygen valve 40, and a switch for controlling activation of fluid fuel valve 42 and/or motor 60 in the pulverized solid fuel feed assembly. As mentioned above, the circuit may comprise one, two or all three of the thermostats. Conventional electrical circuitry not shown, is used for ignition device 52.

Control means for fuel and oxygen other than those described above may be utilized and products of the laser disintegration of solid fuels may be used as the fuel.

Various additional modifications and extensions of this invention will become apparent to those skilled in the art. All such variations and deviations which basically rely on the teachings through which this invention has advanced the art are properly considered to be within the spirit and scope of the invention.

What is claimed:

1. A rapid response steam generator having a heat transfer cylinder having liquid intake means and liquid passage means throughout the length thereof, means for the combustion of fuel circumferentially around the heat transfer cylinder for heating liquid and generating steam within the passage means, means for collecting steam from the passage means for discharging steam for usable steam pressure, the liquid passage means having a plurality of longitudinal grooves for increasing the surface area of heat transfer to liquid for increasing the rapidity of heat transfer and steam generating, and means for fanning the liquid from the intake means outwardly forming a thin layer of liquid for distributing the liquid essentially evenly in the longitudinal grooves, wherein:

the means for fanning the liquid into the thin layer comprises flowing the liquid between a liquid dispersing plate and a geometrically conforming surface, the liquid dispersing plate being urged toward the conforming surface by resilient means.

2. The steam generator defined in claim 1, wherein: the resilient means is a spring.

3. A rapid response steam generator having a heat transfer cylinder having liquid intake means and liquid passage means throughout the length thereof, means for the combustion of fuel circumferentially around the heat transfer cylinder for heating liquid and generating steam within the passage means, means for collecting steam from the passage means for discharging steam for usable steam pressure, the liquid passage means having a plurality of longitudinal grooves for increasing the surface area of heat transfer to liquid for increasing the rapidity of heat transfer and steam generating, and means for fanning the liquid from the intake means outwardly forming a thin layer of liquid for distributing the liquid essentially evenly in the longitudinal grooves, further comprising:

an obturator for directing the flow of liquid and steam within the passage means around the obturator; and wherein, the passage means is tapered, the end adjacent to the liquid intake means being of narrower diameter than the end adjacent to the steam collecting means and the obturator is tapered to conform with the taper of the passage means.

4. The steam generator defined in claim 3, wherein: the obturator is movable within the passage means and is urged toward the narrow end of the passage means by resilient means.

5. The steam generator defined in claim 4, wherein, the resilient means is a spring.

6. The steam generator defined in claim 4, wherein: the passage means further comprises a plurality of longitudinal grooves for increasing the surface area of heat transfer to liquid for increasing the rapidity of heat transfer and steam generation.

7. A rapid response steam generator having a heat transfer cylinder having liquid intake means and liquid passage means throughout the length thereof, means for the combustion of fuel circumferentially around the heat transfer cylinder for heating liquid and generating steam within the passage means, means for collecting steam from the passage means for discharging steam for usable steam pressure, the liquid passage means having a plurality of longitudinal grooves for increasing the surface area of heat transfer to liquid for increasing the rapidity of heat transfer and steam generating, and means for fanning the liquid from the intake means outwardly forming a thin layer of liquid for distributing the liquid essentially evenly in the longitudinal grooves, an obturator for directing the flow of liquid and steam within the passage means around the obturator, means for retaining the liquid passed through the heat transfer cylinder for recirculating the liquid back through the heat transfer cylinder, means for the intake of liquid and storage of liquid, and means for moving the liquid to the heat transfer cylinder via the heat transfer cylinder intake means for producing steam in the heat transfer cylinder, further comprising:

means for controlling the flow of liquid moved to the heat transfer cylinder responsive to the pressure in the steam collecting means for returning the pressure of steam in the steam collecting means to a predetermined target pressure automatically; and the steam collecting means and liquid storing means comprises a cylindrical housing; the steam discharge means is directed upward within the cylindrical housing for providing a liquid trap, for retaining liquid in the cylindrical housing which passes through the heat transfer cylinder.

8. The steam generator defined in claim 7, wherein:

the means for moving the liquid comprises pumping means located in the lower portion of the cylindrical housing.

9. The steam generator defined in claim 8, wherein:

the pumping means comprises a gear pump.

10. The steam generator defined in claim 8, wherein:

the pumping means comprises a rotary sliding vane pump.

11. The steam generator defined in claim 8, further comprising:

a blade rotatably responsive to movement of steam passing through the discharge means, and means for applying rotary movement of the blade to activate the pumping means for moving liquid to the heat transfer cylinder.

12. The steam generator defined in claim 7, wherein:

superheated steam is discharged from the heat transfer cylinder into the cylindrical housing, and means are provided in the cylindrical housing for utilizing the excess heat in superheated steam to generate additional steam.

13. The steam generator defined in claim 12, wherein the excess heat utilizing means comprises:

a fiberous material for retaining liquid for contact with superheated steam, and means for providing liquid to the fiberous material for the retention of liquid by the fiberous material for contact of the liquid with superheated steam.

14. The steam generator defined in claim 12, wherein the excess heat utilizing means comprises:

particulate material for retaining liquid for contact with superheated steam, and means for providing liquid to the particulate matter for the retention of liquid by the particulate matter.

15. The steam generator defined in claim 7, wherein the means for controlling the flow of liquid further comprises:

means for varying the predetermined target steam pressure to a different target pressure.

16. The steam generator defined in claim 15, wherein the means for varying the predetermined target steam pressure comprises:

variable flow valve means for varying the flow of liquid moved to the heat transfer cylinder; the variable flow valve means being responsive to pressure within the cylindrical housing, said pressure urging the valve to the "closed" position, and adjustable means for applying a fluid at a predetermined paressure to urge the valve means to the "open" position.

17. A rapid response steam generator having a heat transfer cylinder with liquid intake means and liquid passage means through the length thereof, means for combustion of fuel circumferentially around the heat transfer cylinder for heating liquid and generating steam within the passage means, means for collecting steam from the passage means for discharging steam for usable steam pressure, the combustion means being a combustion chamber of peripheral annular geometry having passage means eccentrically located for the injection of fuel and oxygen into the combustion chamber for causing the burning fuel to have a circling course around the heat transfer cylinder, further comprising:

an inwardly directed annular ring at the lower portion of the combustion chamber for promoting the retention of unburned fuel and incompletely burned products of combustion in the combustion chamber.

18. A rapid response steam generator, having a heat transfer cylinder with liquid intake means and liquid passage means through the length thereof, means for combustion of fuel circumferentially around the heat transfer cylinder for heating the liquid and generating steam within the passage means, means for collecting steam from the passage means for discharging steam for usable steam pressure, further comprising:

a molecular air separator for separating air into its constituent parts, molecular oxygen for increasing the heat of combustion in the combustion chamber and molecular nitrogen for blowing pulverized solid fuel into the combustion chamber; and, means for blowing pulverized fuel into the combustion chamber with the molecular nitrogen.

* * * * *